US011560759B2

(12) United States Patent
Spits et al.

(10) Patent No.: US 11,560,759 B2
(45) Date of Patent: Jan. 24, 2023

(54) POLYCRYSTALLINE DIAMOND CUTTER ELEMENT AND EARTH BORING TOOL

(71) Applicants: ELEMENT SIX (UK) LIMITED, Didcot (GB); BAKER HUGHES HOLDINGS LLC, Houston, TX (US)

(72) Inventors: Raymond Anthony Spits, Didcot (GB); Gerard Dolan, Spring, TX (US); Emilio Lopez Lopez, Didcot (GB); Changzheng Ji, Didcot (GB); Nicholas J. Lyons, Houston, TX (US); Konrad Izbinski, Houston, TX (US)

(73) Assignee: Element Six (UK) Limited, Didcot (GB)

( * ) Notice: Subject to any disclaimer, the term of this patent is extended or adjusted under 35 U.S.C. 154(b) by 0 days.

(21) Appl. No.: 17/054,192

(22) PCT Filed: May 17, 2019

(86) PCT No.: PCT/EP2019/062792
§ 371 (c)(1),
(2) Date: Nov. 10, 2020

(87) PCT Pub. No.: WO2019/219906
PCT Pub. Date: Nov. 21, 2019

(65) Prior Publication Data

US 2021/0246732 A1 Aug. 12, 2021

Related U.S. Application Data

(60) Provisional application No. 62/673,551, filed on May 18, 2018.

(51) Int. Cl.
*E21B 10/567* (2006.01)
*E21B 10/573* (2006.01)

(52) U.S. Cl.
CPC ..... *E21B 10/5676* (2013.01); *E21B 10/5735* (2013.01)

(58) Field of Classification Search
CPC ..... E21B 10/5676; E21B 10/567; E21B 10/5735; E21B 10/58
See application file for complete search history.

(56) References Cited

U.S. PATENT DOCUMENTS 5,766,394 A 6/1998 Anderson et al.
6,446,740 B2 9/2002 Eyre
(Continued)

FOREIGN PATENT DOCUMENTS

WO 2007089590 A 8/2007

OTHER PUBLICATIONS

United Kingdom Patent Application No. GB1906961.6, Combined Search and Examination Report dated Nov. 14, 2019, 9 pages.
(Continued)

*Primary Examiner* — Blake Michener
(74) *Attorney, Agent, or Firm* — Kilpatrick Townsend & Stockton LLP

(57) ABSTRACT

A cutter element for an earth-boring tool, comprising a polycrystalline diamond (PCD) volume joined at an interface boundary to a cemented carbide substrate. The PCD volume includes a rake face opposite the interface boundary, an edge of the rake face being suitable as a cutting edge of the cutter element. The PCD volume comprises a plurality of strata directly joined to each other at inter-strata boundaries, in which each of a first plurality of the strata comprises PCD material having a first diamond content; each of a second plurality of the strata comprises PCD material having a second diamond content; the second diamond content being greater than the first diamond content; and the strata of the first and second pluralities disposed in an alternating
(Continued)

arrangement with respect to each other. The strata are configured and arranged such that a radial line through the edge and a centroid of the interface boundary intersects, within 1,000 microns from the edge, each of the inter-strata boundaries, and the respective tangent plane to each inter-strata boundary at the respective intersection is disposed relative to the radial line at no less than a minimum angle of 30°.

32 Claims, 7 Drawing Sheets

(56) References Cited

U.S. PATENT DOCUMENTS

| | | | | |
|---|---|---|---|---|
| 8,590,643 | B2 | 11/2013 | Smallman et al. | |
| 8,978,789 | B1 | 3/2015 | Sani et al. | |
| 9,428,967 | B2 | 8/2016 | Scott et al. | |
| 2011/0031033 | A1* | 2/2011 | Mourik | E21B 10/567 175/428 |
| 2012/0037431 | A1* | 2/2012 | DiGiovanni | E21B 10/5676 175/428 |
| 2013/0344309 | A1* | 12/2013 | Adia | B24D 18/0009 428/212 |
| 2014/0076640 | A1* | 3/2014 | Can | E21C 35/183 175/428 |
| 2014/0246252 | A1 | 9/2014 | Scott et al. | |
| 2017/0067294 | A1 | 3/2017 | Can | |
| 2020/0032590 | A1* | 1/2020 | Voronin | E21B 10/55 |

OTHER PUBLICATIONS

International Patent Application No. PCT/EP2019/062792, International Search Report and Written Opinion dated Aug. 21, 2019, 11 pages.

* cited by examiner

POLYCRYSTALLINE DIAMOND CUTTER ELEMENT AND EARTH BORING TOOL

FIELD

This disclosure relates generally to a polycrystalline diamond (PCD) cutter element for an earth-boring tool, particularly but not exclusively for boring into rock for oil or gas drilling, and to earth boring tools comprising same.

BACKGROUND

U.S. Pat. No. 8,590,643 discloses a polycrystalline diamond (PCD) body comprising compressed layers interleaved with tensile layers, respectively comprising different grades of PCD material, and joined to each other by direct diamond-to-diamond bonding. The PCD body may be bonded to a cemented carbide support body, configured for use as a tool such as a drill bit for boring into the earth, or as a pick or an anvil for degrading or breaking hard material such as asphalt or rock. The compressed and tensioned layers may be about 50 microns to about 500 microns thick; they may be arranged substantially parallel to a working surface of the PCD body, or inclined or curved in relation to the working surface.

U.S. Pat. No. 9,428,967 discloses a PCD body for a cutting element, comprising ordered regions having different respective properties, such as different mean grain sizes, and/or different content of super-hard material per unit volume. The regions define a grain interface having a curved portion in a vertical cross-section of the PCD body There is a need for super-hard cutter elements for boring into the earth that exhibit extended working life, particularly but not exclusively for oil or gas drilling, and for earth boring tools comprising the cutter elements.

SUMMARY

Viewed from a first aspect there can be provided a cutter element for an earth-boring tool, such as a drill bit for oil or gas drilling, comprising a polycrystalline diamond (PCD) volume joined at an interface boundary to a cemented carbide substrate; the PCD volume including a rake face opposite the interface boundary, an edge of the rake face being suitable as a cutting edge of the cutter element; and the PCD volume comprising (or consisting essentially of) a plurality of strata directly joined to each other at inter-strata boundaries, in which each of a first plurality of the strata comprises or consists essentially of PCD material having a first diamond content; each of a second plurality of the strata comprises or consists essentially of PCD material having a second diamond content; the second diamond content being greater than the first diamond content; and the strata of the first and second pluralities disposed in an alternating arrangement with respect to each other; the strata configured and arranged such that a radial line through the edge (that is, through a point on the edge, or through any point on the edge, in some examples) and through a centroid of the interface boundary intersects, within a maximum distance of 1,000 microns from the edge, each of the inter-strata boundaries, the respective tangent plane to which at the respective intersection being disposed relative to the radial line at no less than a minimum angle of about 30°.

Diamond grains of adjacent strata are sintered to each other by direct inter-bonding, so that there is no discontinuity of PCD material from one stratum to an adjacent stratum.

Viewed from a second aspect, there is provided an earth boring tool comprising an example cutter element.

Various example arrangements, configurations and uses of cutter elements and tools are envisaged by this disclosure, including the non-limiting and non-exhaustive examples are described below.

In some examples, the edge may extend substantially all the way around the periphery of the rake face; in some examples, the edge may extend along a portion of the periphery of the rake face, and not continually all the way around the periphery; and in some examples, the PCD volume may have a plurality of discontinuous edges.

In some examples, each stratum of the first plurality may have a thickness along the radial line that is greater than that of each stratum of the second plurality (that is, the thicknesses being measured along the radial line).

In some examples, the strata of the first plurality may comprise or consist essentially of PCD material including a first content of binder material, and the strata of the second plurality may comprise or consist essentially of PCD material including a second content of binder material; the first content of binder material being substantially greater than the second content of binder material. The binder material may comprise or consist essentially of non-diamond catalyst material that is capable of promoting the growth and/or inter-growth of diamond crystals. In other examples, the radial line thickness (that is, measured along the radial line) of at least one stratum of the first plurality, or each of the strata of the first plurality, may be greater than the thickness of at least one adjacent stratum of the second plurality. In some examples, the mean thickness of each stratum of the first plurality may be substantially greater than the mean thickness of each stratum of the second plurality.

In some example cutter elements, the maximum distance along the radial line from the edge may be about 500 microns; or at least about 500 microns to at most about 1,000 microns.

In some example cutter elements, the minimum angle between each tangent plane to a respective inter-strata boundary on the one hand and the radial line on the other may be approximately 35°; or approximately 40°; or approximately 45°; or approximately 50°; or approximately 80° to 90°.

In some example cutter elements, the tangent planes to the inter-strata boundary (at the respective intersections with the radial line) may be substantially parallel to each other; or neighbouring inter-strata boundaries may converge towards, or diverge from, each other with longitudinal distance from the interface boundary; and/or the inter-strata boundaries may be substantially concentric, or coaxial, with each other; and/or with a longitudinal axis of the cutter element.

In some example cutter elements, each of the inter-strata boundaries may describe a straight line, or a curved line, or an arcuate line, in a longitudinal cross-section plane including the radial line. In some example arrangements, each inter-strata boundary may include a respective conical area through which the radial line passes; each conical area may correspond to a respective cone angle of 80° to 100°.

In some example arrangements, each of the strata may have an annular configuration; and/or each stratum may be wedge-shaped when viewed in longitudinal cross-section. Adjacent strata may have complementary wedge-shape configurations, in which one of the strata converges in a longitudinal direction (that is, with distance from the interface boundary towards the rake face, or vice versa) and the other of the strata diverges in the longitudinal direction.

In some example arrangements, at least one of the strata may be discontinuous and terminate within the PCD volume. For example, a discontinuous stratum may extend part of the way around a longitudinal axis of the cutter element and have azimuthally opposite ends that terminate within the PCD volume.

In some example cutter elements, the PCD volume may include one or more chamfer surface, and respective tangent planes to each of the strata at the intersection with the radial line may be substantially parallel to a tangent plane to the chamfer surface. At least one chamfer may be coterminous with the edge.

In some example cutter elements, the respective tangent plane to each inter-strata boundary at the intersection with the radial line may be substantially parallel to a longitudinal axis.

In some example cutter elements, the strata may at least partly surround, or entirely encircle, a core region of the PCD volume, with which they may be coaxial. The core region may comprise or consist essentially of a substantially homogeneous grade of PCD material, or a plurality of grades of PCD material.

In some example cutter elements, the PCD volume may have a proximal boundary that is defined by (or coterminous with) the interface boundary; a distal boundary; and a side boundary that connects the proximal and distal boundaries; the distal and side boundaries defining a working boundary; and the strata of the first and second pluralities may extend between the proximal boundary and the working boundary. The strata may intersect the working boundary, and/or the interface boundary; that is, proximal ends of at least some of the strata may be coterminous with the interface boundary (proximal boundary of the PCD volume); and/or distal ends of at least some of the strata may be coterminous with the working boundary of the PCD volume. In some example arrangements, the PCD volume may comprise a proximal region between the interface boundary (the proximal boundary of the PCD volume) and proximal ends of at least some of the strata; and/or the PCD volume may comprise a distal region between distal ends of at least some of the strata and the working boundary of the PCD volume. The proximal and distal regions of the PCD volume may each comprise or consist essentially of a respective homogenous PCD grade, or the same PCD grade.

In some example arrangements, the strata may be shaped such that their longitudinal cross-sections on a plane including the radial line are elongate, having aspect ratios substantially greater than one; for example, the cross-sectional area of at least some of the strata may describe shapes having a substantially greater longitudinal length than radial width.

In some example arrangements, strata of the first and second pluralities may be configured and arranged such that neighbouring inter-strata boundaries diverge from each other with distance from the proximal boundary; or converge towards each other with distance from the proximal boundary; or are substantially parallel to each other.

In some example cutter elements, the PCD volume may comprise a first region coterminous with the rake face and the edge, and a second region contiguous with the first region and remote from the edge of the rake face area; the first region comprising the first and second pluralities of strata, and the second region comprising third and fourth pluralities of strata of PCD material; in which the PCD material of the third strata comprise a substantially different content of diamond than the PCD material of the fourth strata. The strata of the third and fourth pluralities may be disposed in an alternating arrangement with respect to each other, and directly joined to each other at inter-strata boundaries. The strata of the third and fourth pluralities may be configured and arranged such that neighbouring inter-strata boundaries between them are convergent or divergent with distance from the interface boundary. The strata of the third plurality may contain a substantially different content of binder material than the strata of the further plurality.

In some example cutter elements, the PCD volume may comprise a surface region that is coterminous with at least an area of the working boundary and including no more than about 2 wt. % of catalyst material for diamond. For example, the surface region may be coterminous with an area of the rake face, and/or a side of the PCD volume; and/or the surface region may comprise interstitial voids among the plurality of directly inter-bonded diamond grains, which may be provided by acid leaching binder material from the interstices. In some examples, the voids may be at least partly filled with material that is not suitable as catalyst material for sintering diamond.

In some example cutter elements, at least one or two of the strata, or all the strata, of the first and second pluralities may be substantially free of catalyst material for diamond; and/or the interstices between the sintered diamond grains of the first and/or second pluralities may comprise voids, or include binder or filler material that is not suitable for promoting the direct sintering of the diamond grains.

In some example cutter elements, the PCD material of the first plurality may comprise diamond grains having a first mean size, and the PCD material of the second plurality may comprise diamond grains having a second mean size; the first mean grain size being less than the second mean grain size. For example, the PCD material of the first plurality may be formed of diamond grains having a mean grain size of at least about 0.5 microns, and/or at most about 15 microns; and the PCD material of the second plurality may be formed of diamond grains having a mean grain size of at least about 10 microns, and/or at most about 90 microns, or at most about 30 microns.

In some example cutter elements, the PCD material of the second plurality may be harder than the PCD material of the first plurality.

In some example cutter elements, each of the strata of the first plurality may have a first mean thickness; and each of the strata of the second plurality may have a second mean thickness; the first and the second mean thickness being at least about 8 microns, or at least about 50 microns; and/or at most about 500 microns. The mean or minimum thickness of a stratum may be at least about two or three times the D90 size of the diamond grains comprised in the stratum.

In some example cutter elements, the PCD material of the strata of the first plurality may comprise a binder content of at least about 10 wt. %, and/or at most about 25 wt. %; and the PCD material of the strata of the second plurality may comprise a binder content of at least about 5 wt. %, and/or at most about 15 wt. %.

In some example cutter elements, the PCD material of the strata of the first plurality may comprise a diamond content of at least about 85 vol. %, and/or at most about 95 vol. %; and the PCD material of the strata of the second plurality may comprise a diamond content of at least about 90 vol. %, and/or at most about 98 vol. %.

In some example cutter elements, the PCD volume may comprise a third plurality of strata of PCD material; the first, second and third strata disposed in an alternating arrangement with respect to each other, such that each stratum of the second plurality is joined at an inter-strata boundary on one side to a stratum of the first plurality, and at another inter-strata boundary on the opposite side to a stratum of the third plurality; in which the content of diamond material in the PCD material of the third plurality is greater than that of the strata of the second and first pluralities.

In some example cutter element, the PCD material of the strata of the first plurality, and/or of the second plurality may include elongate grains of non-diamond material (for example, ceramic whiskers, such as SiC whiskers).

In some example cutter elements, the strata of the first and second pluralities may each comprise, or consist essentially of, a different respective grade of PCD, the different grades exhibiting substantially different mechanical properties, such as different coefficients of thermal expansion (CTE), fracture toughness (e.g., Kic toughness), and/or abrasive wear rate (the properties of the grades may be measured using suitably dimensioned bodies consisting essentially of the relevant PCD grade).

In various examples, the strata of the first and second pluralities may be arranged for controlling the rate and/or the path of cracks propagating through the PCD volume, particularly cracks that originate within about 1 mm, or within about 0.5 mm, or about 0.5 mm to about 1 mm from the edge in use. Example compositions, configurations and arrangements of PCD strata may mitigate, avoid or delay catastrophic damage to the PCD volume.

While wishing not to be bound by a particular theory, a crack originating within approximately 1 mm from the edge, or within approximately 0.5 mm from the edge, and propagating into the PCD volume may be deflected, retarded or stopped as a result of intersecting an inter-strata boundary at angle of at least about 30°. In some examples, the strata may be arranged such that a crack may be deflected away from a region of the PCD volume where there would be a high risk of spalling or other fracture of the PCD volume; put differently, the strata may be arranged for deflecting or guiding a crack to a region of the PCD volume where the risk of catastrophic failure of the cutter element may be substantially reduced, thus potentially extending the working life of the cutter element.

BRIEF DESCRIPTION OF THE DRAWINGS

Non-limiting example configurations and arrangements of cutter elements and earth-boring tools will be described with reference to the accompanying drawings, in which.

DETAILED DESCRIPTION

Figure 1:
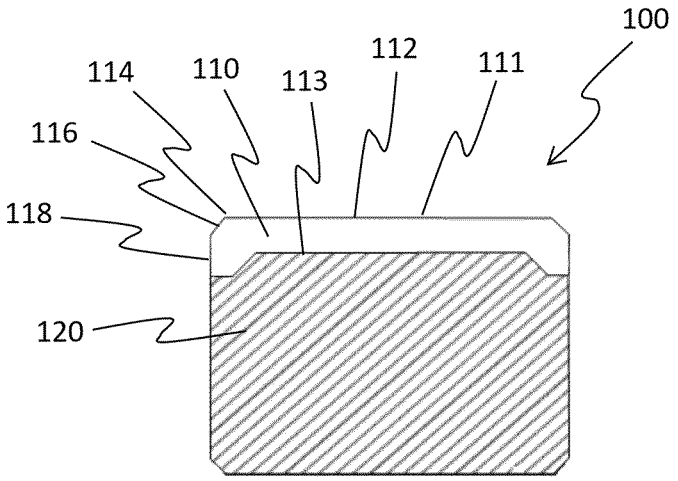
FIG. 1 is a schematic drawing of longitudinal cross-section view through an example cutter element.

With reference to FIG. 1, an example cutter element 100 comprises a polycrystalline diamond (PCD) volume 110 joined at an interface boundary 113 to a substrate 120 that may include or be formed of, for example, cobalt-cemented tungsten carbide material. The PCD volume 110 includes a rake face 112 opposite the interface boundary 113, and a side surface 118 connecting the interface boundary 113 and the rake face 112. An edge 114 of the rake face 112 will be suitable as a cutting edge when the cutter element 100 is mounted onto a tool bit for boring into rock, in which the edge 114, which forms a cutting edge, will be driven against the rock with sufficient force to break or shear the rock, and broken pieces of rock will be removed over the rake face 112. The side surface 118 of the PCD volume 110 may include a chamfer portion 116 coterminous with the rake face 112 at the edge 114. In some example configurations, the cutter element 100 may have a substantially cylindrical external shape, the edge 114 and chamfer portion 116 extending all the way around the periphery of the rake face 112; and in other example configurations, the cutter element 100 may be substantially non-cylindrical in shape; and the edge 114 may extend only part of the way around the rake face 112. In various example configurations, the rake face 112 may be substantially planar or substantially non-planar.

Figure 2:
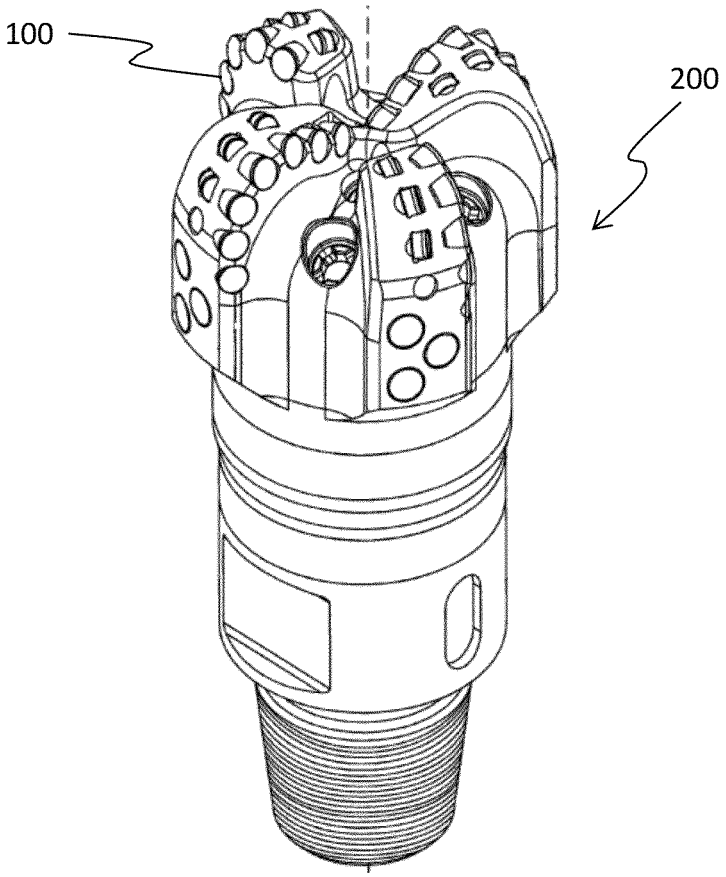
FIG. 2 is a schematic perspective drawing of an example earth-boring bit.

With reference to FIG. 2, an example fixed-cutter drill bit 200 for oil and gas drilling may comprise a plurality of example cutter elements 100 attached to the body of the bit 200. A proximal end of the substrate 120 of each cutter element 100 may be brazed into a respective pocket provided in the bit body, the respective PCD volume 110 defining an exposed rake face 112 (that is, distal end) of the cutter element 100.

Figure 3:
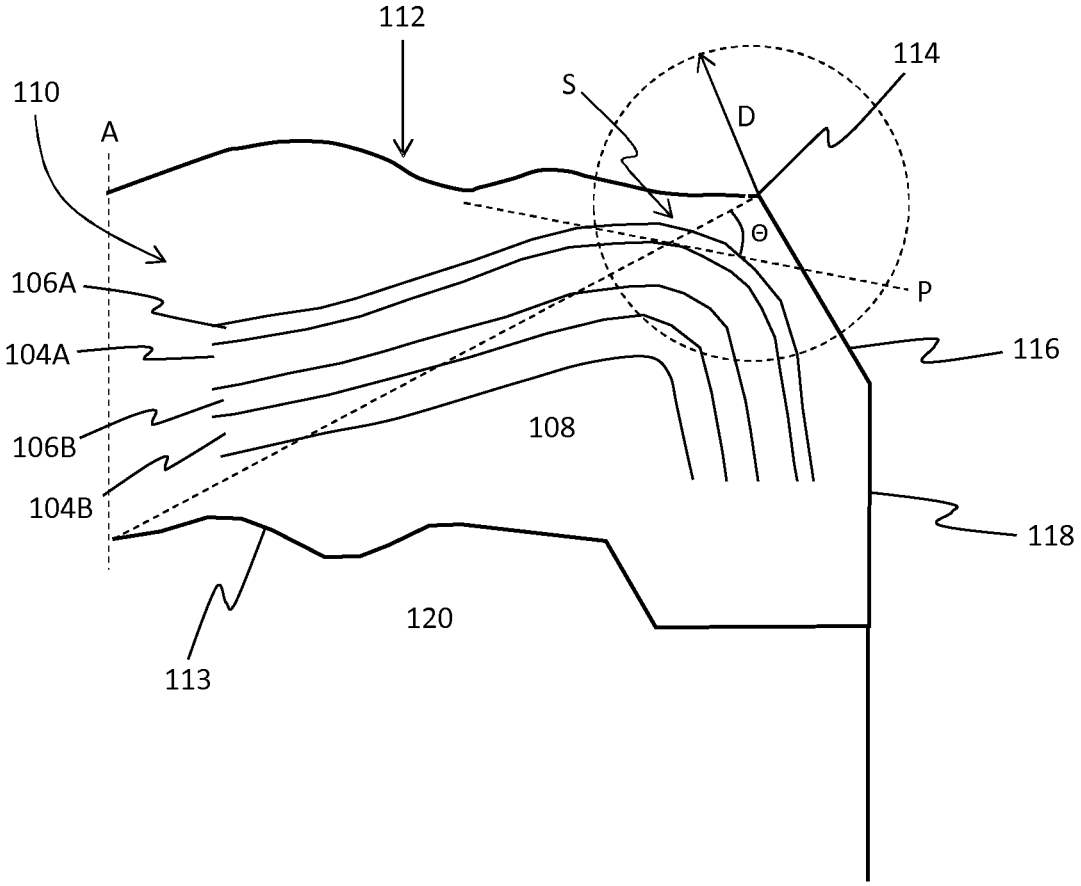
FIGS. 3 and 4 are schematic drawings of longitudinal cross-sections through portions of example cutter elements.
Figure 4:
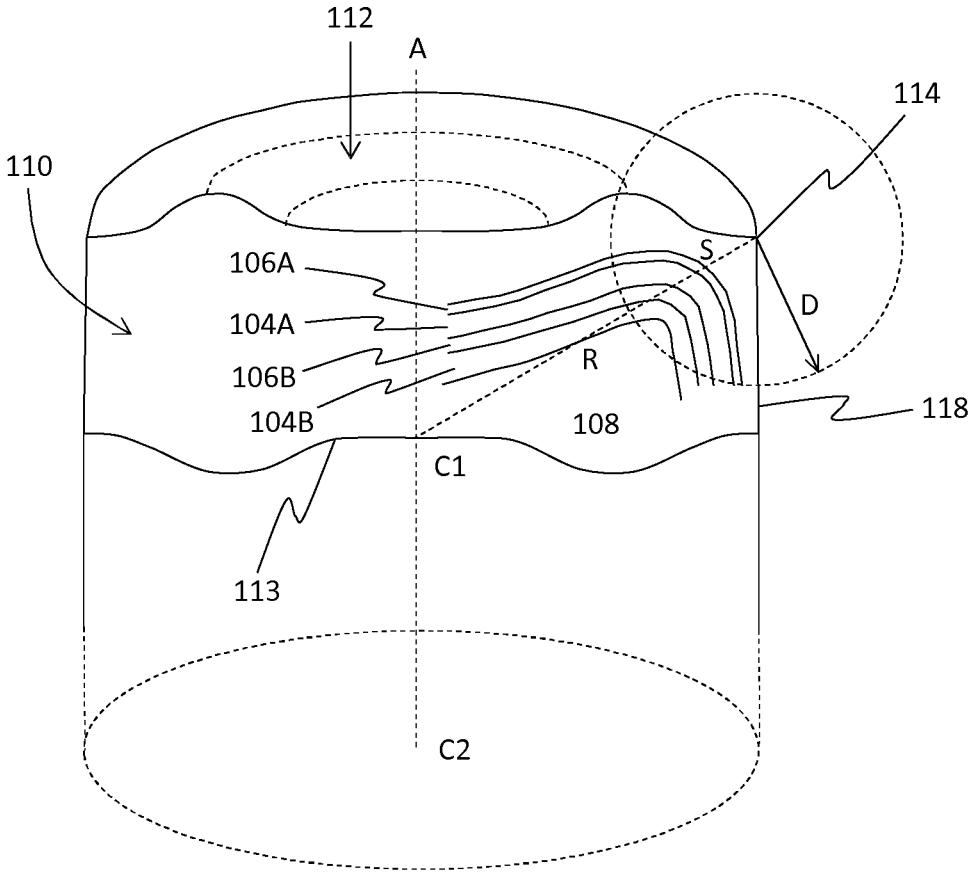

With reference to FIGS. 3 and 4, the PCD volume 110 may comprise at least two pairs of strata 106A, 104A, and 106B, 104B in an inter-leaved arrangement and each stratum in the pair being directly joined to the other along a respective inter-strata boundary. In the particular illustrated example, the two strata 104A, 104B of the first pair may comprise a first grade of PCD material, and the two strata 106A, 106B of the second pair may comprise a second grade of PCD material, the first grade of PCD containing, for example, less diamond than the second grade of PCD, in terms of volume percentage. In a particular example, the first pair of strata 104A, 104B may contain less binder material than the second pair of strata 106A, 106B. In the example arrangement, certain mechanical properties of the PCD volume alternate with the transitions from one stratum 104A, 104B to the next 106A, 106B, as a function of the alternating diamond content and associated microstructure. In the particular examples illustrated in FIGS. 3 and 4, the PCD volume 110 may comprise a non-stratified region 108 in addition to the strata 104A, 104B, 106A, 106B. The strata 106A, 104A, 106B, 104B in this example are curved convexly towards the edge 114, in both the illustrated longitudinal cross-section view and a transverse cross-section view (not shown), such that each of the inter-strata boundaries includes a respective curved area S, which also extends convexly towards the edge. An imaginary radial line R (see FIG. 4) connecting the edge 114 and a centroid C1 of the interface boundary 113 coincidingly intersects the curved area S of the inter-strata boundaries and a tangent plane P to the curved area S, at a distance from the edge 114 (along the radial line R) of at most a maximum distance D of about 1 mm. In the illustrated examples, the minimum angle Θ between tangent plane P and the radial line R may be approximately 35°-40°; and in some examples, the minimum angle Θ may be approximately 45°-55°.

In the particular examples illustrated in FIGS. 3 and 4, the side surface 118 connecting the interface boundary 113 to the rake face 112 includes a substantially cylindrical area, the side surface 118 meeting the rake face at the edge 114. A longitudinal axis A of the cutter element 100 may be defined as a straight line passing through the centroids C1, C2 of the interface boundary 113 and the proximal end of the substrate 120, respectively. Since the perimeter of the interface boundary 113 projected onto a transverse plane describes a circle, the centroid C1 through which the radial line R and the longitudinal axis pass, is the centre of the projected circle. The example cutter element illustrated in FIG. 3 does not include a chamfer adjacent the edge 114; and the example cutter element illustrated in FIG. 4 does include a chamfer area 116 adjacent the edge 114. In some example cutter elements, the side surface 118 of the PCD volume 110 may include a plurality of chamfer portions or regions. The rake face 112 and the interface boundary 113 are illustrated as being non-planar over most of their respective areas, although in other examples, one or both may be substantially non-planar.

Figure 5:
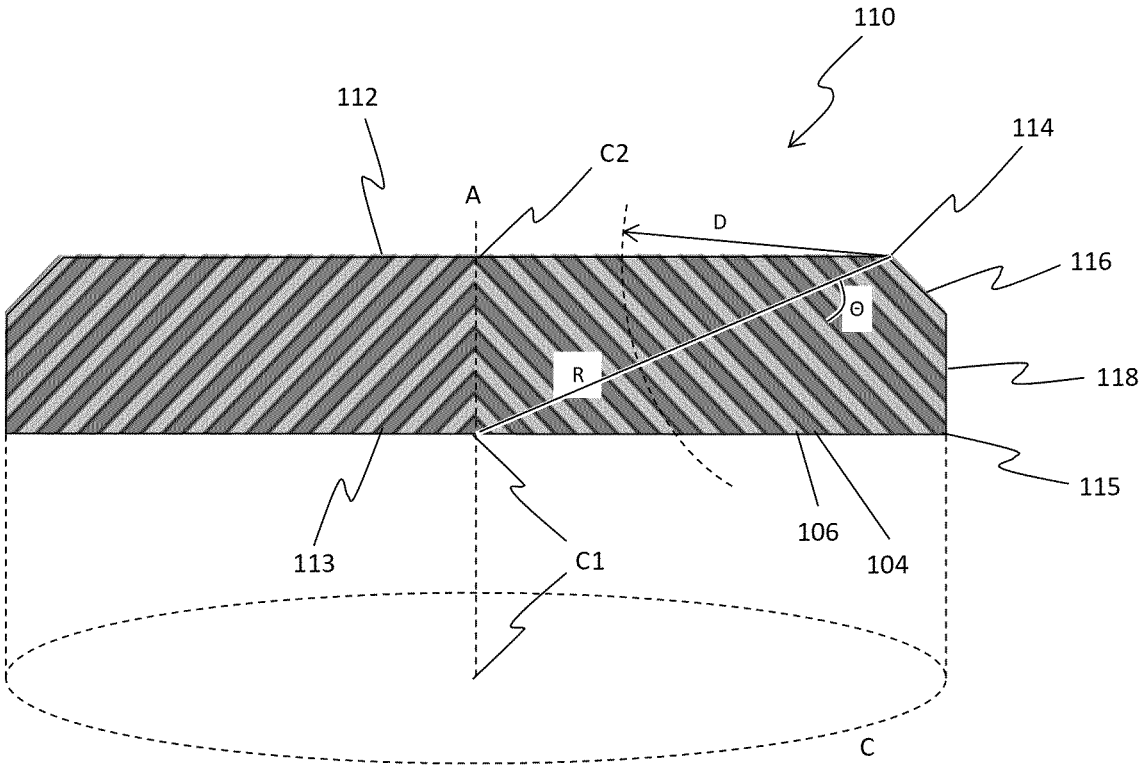
FIGS. 5 to 10 are schematic drawings of longitudinal cross-sections through PCD volumes of example cutter elements.

To illustrate various example configurations of alternating PCD strata 104, 106, FIGS. 5 to 10 show example PCD volumes 110 having substantially the same external shapes. Each of the example PCD volumes 110 has a proximal boundary 113, a distal boundary 112 and a side surface 118 connecting the proximal 113 and distal 112 boundaries. The PCD volume 110 may be metallurgically bonded to a cemented carbide substrate (not shown) at an interface boundary corresponding to the proximal boundary 113 of the PCD volume 110, and the distal boundary of the PCD volume 110 defines a rake face 112 of the cutter element. In these examples a chamfer portion 116 extends conically from the edge 114 of the distal boundary 112 to the side surface 118, and a cylindrical area connects the chamfer portion 116 and the proximal boundary 113. The edge 114 and chamfer portion 116 extend azimuthally all the way around the periphery of the distal boundary 112. Although the proximal 113 and distal 112 boundaries of the PCD volume are illustrated as being planar, one or both of these boundaries 113, 112 may be non-planar. A longitudinal axis A of the cutter element (and the PCD volume 110 on its own) can be defined through the centroid C1 of the proximal boundary (interface boundary) 113 and the centroid C2 of the proximal end of the substrate 120. Since both the interface boundary 113 and the proximal end of the substrate 120 in this particular example has a respective circular periphery, the longitudinal axis A is the central longitudinal axis through the cylindrical portion defined by the base of the substrate and the side surface 118 extending therefrom. For example, FIG. 5 shows the circular projection C of the periphery 115 of the proximal boundary 113 of the PCD volume 110 onto a transverse plane (that is, a plane perpendicular to the longitudinal axis A). In various non-limiting examples, the diameter of the circular projection C may be about 9 mm, about 12 mm about 16 mm or about 22 mm.

The illustrated example PCD volumes 110 are formed of two groups 104, 106 of PCD strata that are directly inter-bonded to each other at inter-strata boundaries (there are about 10-28 strata in the various examples illustrated). Each stratum may have a mean thickness of about 200 microns to about 300 microns. The strata of the two groups 104, 106 may be include two different respective grades of PCD; in other words, each stratum of the first group 104 may include a first grade of PCD material, and each stratum of the second group 106 may include a second grade of PCD material, the two grades differing at least in the volume content of sintered diamond grains. The strata of the two groups 104, 106 are arranged in alternating order, in which diamond grains of neighbouring strata are directly sintered (inter-bonded) to each other to form a contiguous PCD volume.

With reference to FIG. 5, the strata 104, 106 are configured such that the inter-strata boundaries describe substantially conical surface areas, each disposed at an acute angle of about 45° with respect to the longitudinal axis A. The inter-strata boundaries are substantially parallel to each other and to the chamfer 116 when viewed in longitudinal cross-section, with a respective proximal end of each stratum 104, 106 being coterminous with the proximal boundary 113 or side surface 118 of the PCD volume 110, and a respective distal end of each stratum 104, 106 being coterminous with the distal boundary 112 of the PCD volume 110. In this example, tangent planes to the inter-strata boundaries lie at an acute angle Θ of about 60° to radial lines R connecting points on the edge 114 to the centroid C1 of the proximal boundary 113 of the PCD volume 110 (any radial line R in this example will intersect a plurality of inter-strata boundaries within a distance D of at least 1 mm from the edge, at the same angle Θ).

Figure 6:
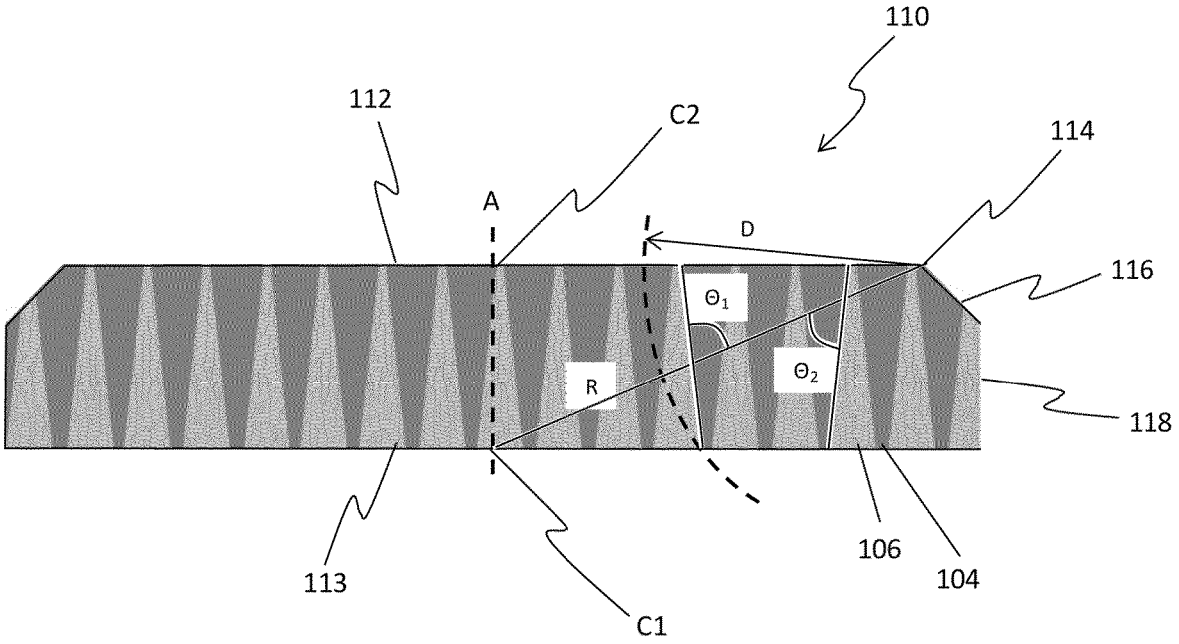

With reference to FIG. 6, an example cutter element may comprise a PCD volume 110 formed of two groups of PCD strata 104, 106, each stratum configured as a ring having a wedge-like longitudinal cross-section. A respective proximal end of each stratum 104, 106 is coterminous with the proximal boundary 113 of the PCD volume 110, and a respective distal end of each stratum 104, 106 is coterminous with the distal (working) boundary 112 of the PCD volume 110. Each stratum of the first group 104 is configured such that its sides diverge with distance from the proximal boundary 113 towards the distal boundary 112, and each stratum of the second group 106 is configured such that its sides converge with distance from the proximal boundary 113 towards the distal boundary 112; the strata of the first 104 and second 106 groups are thus cooperatively configured and arranged. Each of a first group of inter-strata boundaries is disposed at an acute angle $\Theta_1$ of about 72° to a radial line R, and each of a second group of inter-strata boundaries is disposed at an acute angle $\Theta_2$ of about 60° to the radial line R.

Figure 7:
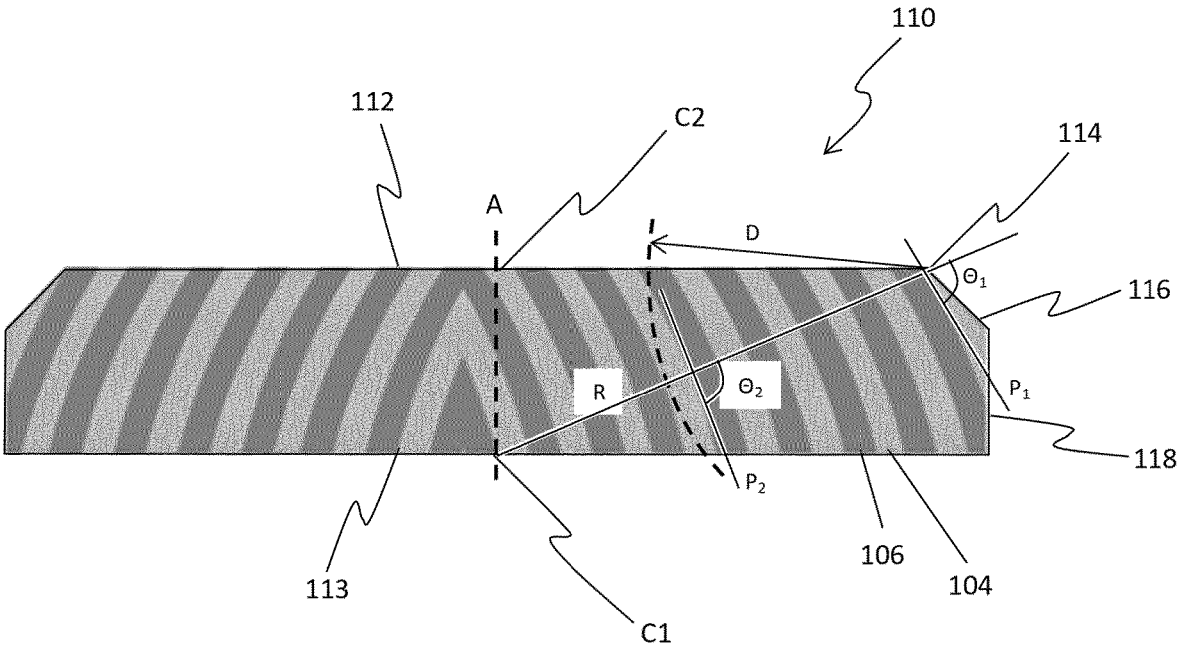

With reference to FIG. 7, an example cutter element may comprise a PCD volume 110 formed of two groups of PCD strata 104, 106, each stratum configured as an inwardly-curved ring; that is, inwardly-curving with increasing distance from the proximal boundary 113 of the PCD volume 110. In this example, the strata 104, 106 are configured and arranged such that the inter-strata boundaries are substantially "parallel" to each other; that is, they curve along substantially the same arc spaced substantially equidistantly along their length. The respective proximal end of each stratum 104, 106 is coterminous with the proximal boundary 113 of the PCD volume 110 (except for the radially outermost stratum, the proximal end of which is coterminous with the side surface 118), and a respective distal end of each stratum 104, 106 is coterminous with the distal boundary 112 of the PCD volume 110. Depending where a radial line R intersects each inter-strata boundary (at respective distances within a maximum distance D of 1 mm from the edge), a tangent plane $P_1$-$P_2$ to each inter-strata boundary coincidingly intersected by the radial line R is disposed at an acute angle in a range of angles $\Theta_1$-$\Theta_2$ of about 80°-90° to the radial line R.

Figure 8:
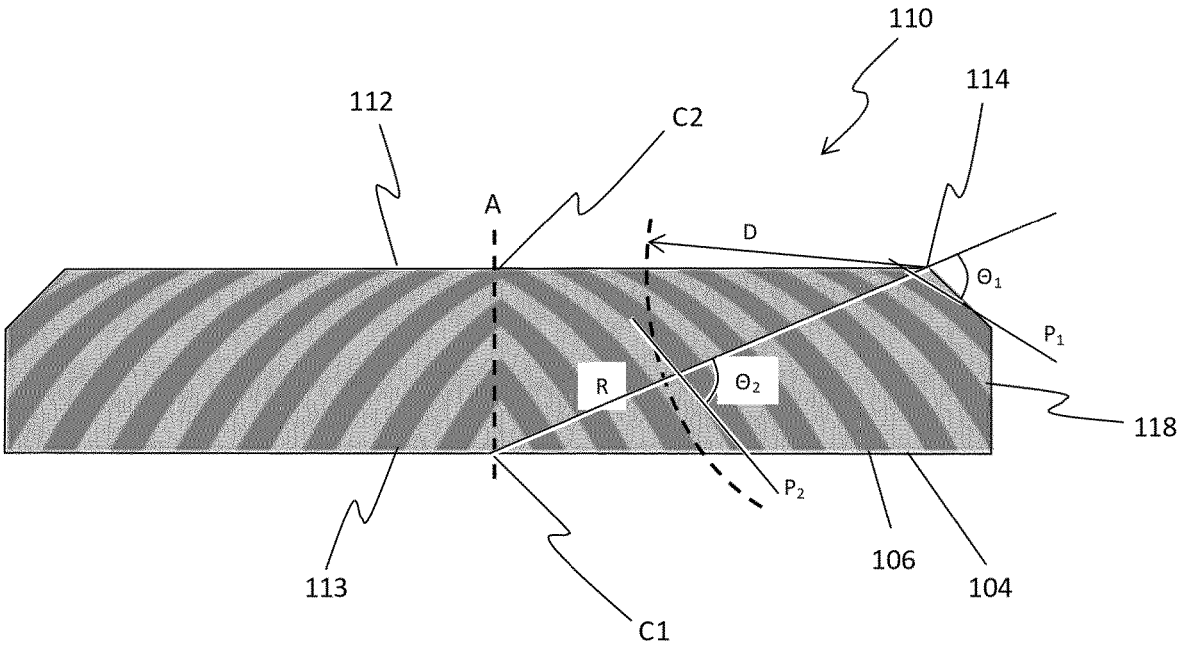

With reference to FIG. 8, an example cutter element may comprise a PCD volume 110 formed of two groups of PCD strata 104, 106, each stratum configured as an inwardly-curved ring; that is, inwardly-curving with increasing distance from the proximal boundary 113 of the PCD volume 110. In this example, the strata 104, 106 are configured and arranged such that the inter-strata boundaries converge towards each other with distance from the proximal boundary 113 towards the distal boundary 112. The respective proximal end of each stratum 104, 106 is coterminous with the proximal boundary 113 or side surface 118 of the PCD volume 110, and a respective distal end of each stratum 104, 106 is coterminous with the distal boundary 112 of the PCD volume 110. Depending where a radial line R intersects each inter-strata boundary (at respective distances within a maximum distance D of 1 mm from the edge), a tangent plane $P_1$-$P_2$ to each inter-strata boundary coincidingly intersected by the radial line R is disposed at an acute angle in a range of angles $\Theta_1$-$\Theta_2$ of about 47°-72° to the radial line R.

Figure 9:
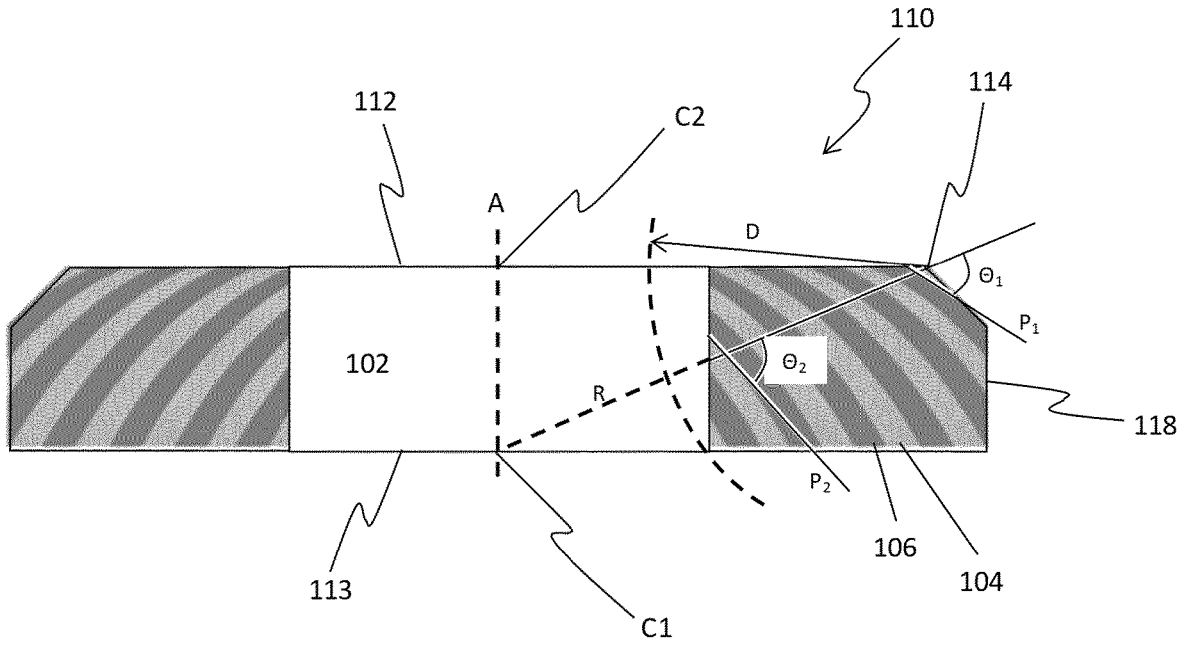

With reference to FIG. 9, an example cutter element may comprise a PCD volume 110 formed of two groups of PCD strata 104, 106, each stratum configured as an inwardly-curved ring; that is, inwardly-curving with increasing distance from the proximal boundary 113 of the PCD volume 110. As in the example described with reference to FIG. 8, the strata 104, 106 are configured and arranged such that the inter-strata boundaries converge towards each other with distance from the proximal boundary 113 towards the distal boundary 112. However, in this example, the PCD volume 100 comprises a substantially cylindrical central region 102 that is free of strata, comprising, for example, a single PCD grade having a substantially homogeneous microstructure and volume percentage of sintered diamond grains. A radial line R intersects the diameter of the central region 102 at a distance of less than the maximum distance D of 1 mm, in this example, and respective distal ends of some of the strata are coterminous with a cylindrical side of the central region 102. Depending where a radial line R intersects each inter-strata boundary (at respective distances within a maximum distance D of 1 mm from the edge), a tangent plane $P_1$-$P_2$ to each inter-strata boundary coincidingly intersected by the radial line R is disposed at an acute angle in a range of angles $\Theta_1$-$\Theta_2$ of about 47°-69° to the radial line R.

Figure 10:
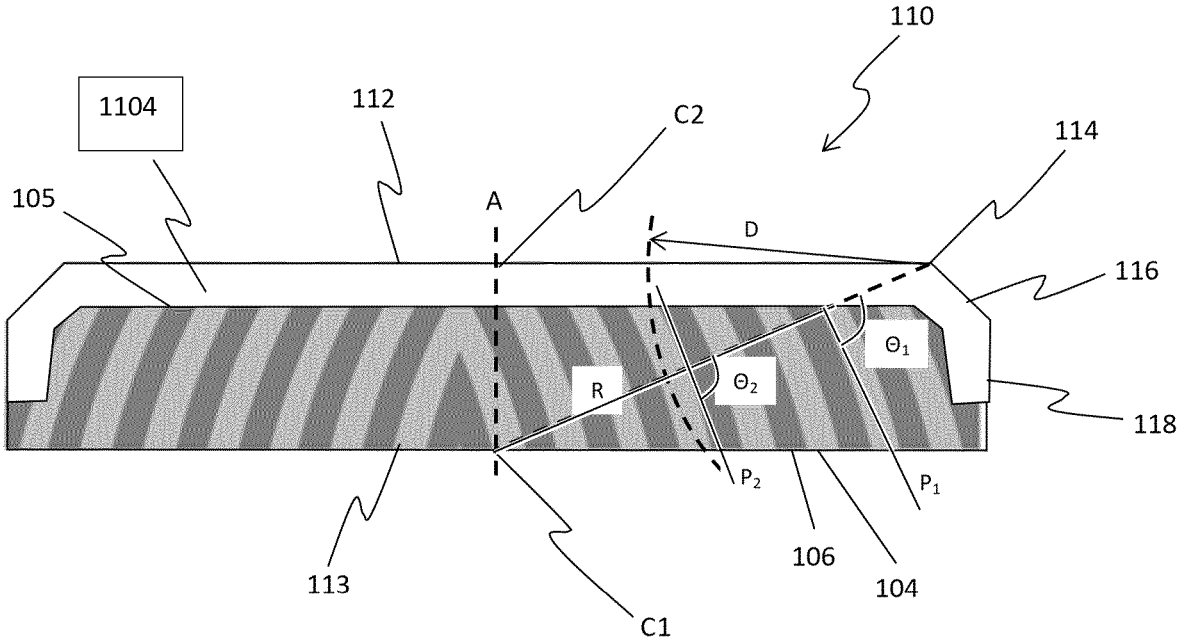

With reference to FIG. 10, an example cutter element may comprise a PCD volume 110 formed of two groups of PCD strata 104, 106, each stratum configured as an inwardly-curved ring, in which the strata 104, 106 are configured and arranged such that the inter-strata boundaries are substantially "parallel" to each other, as described with reference to FIG. 7. However, in this example, the PCD volume 110 includes a surface region 1104 that is coterminous with the distal boundary 112 and part of the side surface 118 of the PCD volume 110, and which contains less than 2 wt. % binder material. This may be achieved by treating the PCD volume 110 with acid to leach out most, or substantially all of the catalyst material for diamond that had been included in the interstices between the sintered diamond grains. Depending where a radial line R intersects each inter-strata boundary, a tangent plane $P_1$-$P_2$ to each inter-strata boundary coincidingly intersected by the radial line R is disposed at an acute angle in a range of angles $\Theta_1$-$\Theta_2$ of about 83°-90° to the radial line R.

In some examples, the surface region 1104 may comprise alternating strata of different grades of leached PCD, in which neighbouring strata contain substantially different contents of sintered diamond grains, the interstices between the diamond grains comprising voids (that is, gas). In other examples, the interstices between the diamond grains on the surface region may include non-diamond material, such as certain metal alloys, that is not suitable for promoting the sintering of diamond grains. This may be achieved by filling interstitial voids with molten material. In some examples, the surface region 1104 may be substantially homogeneous. The surface region 1104 may have a substantially uniform thickness (that is, depth from the working boundary 118, 112); and the mean depth of the surface region 1104 may be at most about 200 microns, or at most about 100 microns, or at most about 50 microns.

Example methods of making cutter elements may include forming two or more pluralities of strata-precursor bodies that contain diamond grains held together by binder material, formed in shapes suitable for forming the PCD strata in the PCD volume, in response to being sintered. Various methods of making the strata-precursor bodies are envisaged. Some example methods may include providing sheets comprising diamond grains held together by binder material, and then processing the sheets to form the strata-precursor bodies; and other example methods may not involve providing and processing sheets.

An example method for making a volume of PCD material comprising two pluralities of strata comprising different respective PCD grades, may include providing two pluralities of sheets, each comprising, or consisting essentially of, aggregations of diamond grains held together by organic binder material. The sheets of each of the two pluralities may differ from each other in accordance with the differences between the respective PCD materials of the respective strata; for example, the size distributions of the diamond grains in each of the two pluralities of sheets may differ substantially from each other; and/or respective contents of catalyst material for diamond (or precursor material for the catalyst material), and/or respective additives may differ substantially from each other. The sheets may also contain catalyst material for diamond, such as cobalt, or precursor compounds for providing the catalyst material in a suitable form, and/or additives for inhibiting abnormal growth of the diamond grains, or for enhancing or modifying certain properties of the PCD material. For example, the strata-precursor bodies may contain about 0.5 wt. % (weight percent) to about 5 wt. % of one or more of vanadium carbide, chromium carbide or tungsten carbide, as additive compounds. In one example, each of the plurality of discs may comprise about 10 to 20 discs.

In various examples, the strata-precursor bodies of the first plurality may contain diamond grains having a mean size of at least about 0.1 micron to at most about 15 microns; and/or the strata-precursor bodies of the second plurality may contain diamond grains having a mean size of at least about 10 microns and at most about 40 microns. For example, the mean size of the diamond grains in the first plurality of strata-precursor bodies may be at least about 0.1 microns or at least about 1 micron; and/or at most about 10 microns, at most about 5 microns or at most about 2 microns. In some examples, the mean size of the diamond grains in the second plurality of strata-precursor bodies may be at least about 5 microns, at least about 10 microns or at least about 15 microns; and/or at most about 30 microns or at most about 50 microns.

The sheets may be formed by means of an extrusion or tape casting process. Slurries comprising the diamond grains having respective size distributions suitable for making the desired PCD grades, and organic binder material such as methyl cellulose or polyethylene glycol (PEG) in a water-borne form (for example, as a solution, emulsion, or suspension) may be spread onto a surface and allowed to dry. Other methods for making diamond-containing sheets may also be used, such as described in U.S. Pat. Nos. 5,766,394 and 6,446,740; and alternative methods may include a spraying process, such as thermal spraying.

In some example methods, respective first and second pluralities of discs, or wafers, may be cut or punched from each of the pluralities of sheets. In various examples, the sheets may be formed into shapes according to the configuration and arrangement of the strata in the PCD volume. For example, respective pluralities of strips may be cut from each of the sheets, and the strips configured in the form of rings, describing substantially cylindrical or conical surfaces. In some examples, each of the sheets may be shredded or processed in some other way to form respective pluralities of granules, or flakes, which may be combined to form respective sets of diamond-containing bodies having various shapes, such as rings having wedge-shaped cross-sections.

An example method may include providing a cemented carbide substrate body comprising, or consisting essentially of, a plurality of tungsten carbide grains and cobalt cementing material. In other examples, the cemented carbide substrate body may comprise a different kind of metal carbide grains, and/or a different cementing metal or metal alloy. The substrate body may have proximal and distal ends connected by a side surface, which may have a cylindrical shape, in which the distal end may be substantially planar or non-planar, and on which the volume of PCD is to be formed. In other words, the distal end of the substrate and a proximal boundary of the PCD volume may define the interface boundary between the PCD volume and the substrate in the sintered tool element. A non-planar shape of the interface boundary may be configured to reduce undesirable residual stress between the PCD structure and the support body.

An example method may include providing a cup, within which the diamond-containing strata-precursor bodies can be arranged in alternating order, and the distal end of the substrate body placed against the arranged strata-precursor bodies to form a pre-sinter assembly. For example, strata-precursor bodies in the form of discs or rings may be stacked, or otherwise arranged, in alternating order against a closed end of the cup. In one example method, a layer of substantially loose diamond grains may be packed onto the uppermost of the discs, and the substrate body pushed against the layer of substantially loose diamond grains, causing them to move slightly and position themselves according to the shape of the distal end of the substrate body. An example method may include packing the pre-sinter assembly into a capsule for an ultra-high pressure press; and an example method may include heating the strata-precursor bodies to remove the organic binder material comprised in them.

Example methods may include subjecting the capsule to an ultra-high pressure of at least about 5.5 GPa, or at least about 6.5 GPa, or at least about 7.5 GPa, and a high temperature of at least about 1,300° C. to sinter the diamond grains and form the PCD volume integrally joined to the support body. In one version of the method, when the pre-sinter assembly is treated at the ultra-high pressure and high temperature, cementing material within the substrate body may melt and infiltrates among the diamond grains. In examples where the cementing material comprises catalyst material for diamond, such as cobalt, the presence of the molten catalyst material from the substrate body may promote the sintering of the diamond grains by intergrowth with each other, to form an integral, stratified PCD volume.

As used herein, the diamond content of a PCD stratum is measured in terms of the surface area of diamond on a polished cross-section surface through the stratum, relative to the area of non-diamond material, including open voids, on the cross-section surface. This measurement and the path traced by a stratum when viewed on an image of a polished section, and also the determination of the tangent plane to an inter-strata boundary using an image of a polished section may be determined/measured using conventional optical microscopy or SEM image analysis analysis techniques. For example, in measuring these parameters by means of image analysis of SEM images, several images of different parts of a surface or section (hereinafter referred to as samples) are used to enhance the reliability and accuracy. The number of images used to measure a given quantity or parameter may be, for example between 10 to 30. If the analysed sample is uniform, which is the case for PCD, depending on magnification, 10 to 20 images may be considered to represent that sample sufficiently well.

The resolution of the images needs to be sufficiently high for the boundaries to be clearly made out and, for the measurements stated herein an image area of 1280 by 960 pixels was used. Images used for the image analysis were obtained by means of scanning electron micrographs (SEM) taken using a backscattered electron signal. The back-scatter mode was chosen so as to provide high contrast based on different atomic numbers and to reduce sensitivity to surface damage (as compared with the secondary electron imaging mode).

1. A sample piece of the PCD sintered body is cut using wire EDM and polished. At least 10 back scatter electron images of the surface of the sample are taken using a Scanning Electron Microscope at 1000 times magnification.
2. The original image was converted to a greyscale image. The image contrast level was set by ensuring the diamond peak intensity in the grey scale histogram image occurred between 10 and 20.
3. An auto threshold feature was used to binarise the image and specifically to obtain clear resolution of the diamond and binder phases.
4. The software, having the trade name analySIS Pro from Soft Imaging System® GmbH (a trademark of Olympus Soft Imaging Solutions GmbH) was used and excluded from the analysis any particles which touched the boundaries of the image. This required appropriate choice of the image magnification:
   a. If too low then resolution of fine particles is reduced.
   b. If too high then:
   i. Efficiency of coarse grain separation is reduced.
   ii. High numbers of coarse grains are cut by the boarders of the image and hence less of these grains are analysed.
   iii. Thus more images must be analysed to get a statistically-meaningful result.
5. Each particle was finally represented by the number of continuous pixels of which it is formed.
6. The AnalySIS software programme proceeded to detect and analyse each particle in the image. This was automatically repeated for several images.
7. Ten SEM images were analyzed using the grey-scale to identify the binderpools as distinct from the other phases within the sample. The threshold value for the SEM was then determined by selecting a maximum value for binder pools content which only identifies binder pools and excludes all other phases (whether grey or white). Once this threshold value is identified it is used to binarize the SEM image.)
8. One pixel thick lines were superimposed across the width of the binarized image, with each line being five pixels apart (to ensure the measurement is sufficiently representative in statistical terms). Binder phase that are cut by image boundaries were excluded in these measurements.
9. The surface area of the diamond content for each stratum in each cross-sectional image was calculated and recorded—at least 10,000 measurements were made per material being analysed—calculating the surface area from measurement of the median values of the diamond phase mean free paths in each image.

The term "median" in this context is considered to have its conventional meaning, namely the numerical value separating the higher half of the data sample from the lower half.

The grain size contrast as highlighted by this analysis technique between two adjacent strata/layers is used to demarcate the boundary of one strata and the beginning of the next. The distance measured between the two boundaries associated with each strata will define the 'thickness' of the strata.

While wishing not to be bound by a particular theory, when the stratified PCD volume is allowed to cool from the high temperature at which it was formed by sintering, alternating strata containing different amounts of metal catalyst material may contract at different rates. This may be because metal contracts much more substantially than diamond as it cools from a high temperature. This differential rate of contraction may cause adjacent strata to pull against each other, thus inducing opposing stresses in them.

Certain example methods of producing a tool element may include processing the PCD volume by means of grinding, to form its shape and dimensions to within required tolerances. Some example methods may include treating the PCD volume to remove catalyst material from a region coterminous with an area of the working boundary, for example by using acid to leach out catalyst material from between the diamond grains, or by using an electrochemical technique. A substantially porous region including at most 2 wt. % catalyst material may extend to a depth of at least about 50 microns, or at least about 100 microns, from an area of the working boundary of the PCD volume.

While wishing not to be bound by a particular theory, the PCD grades, configurations and arrangements of the PCD strata may be selected for reducing the crack propagation rate sufficiently for a developing wear flat (that is, a wear surface area evolving on the super-hard body as a consequence of super-hard material being removed in use) to catch up with the crack, such that the crack is removed as the surrounding PCD material is worn away in use. Thus, the risk of catastrophic fracture of the PCD material may be reduced or substantially eliminated. In some examples, a stratum of the second plurality may be exposed to wear against the workpiece, and owing to its relative softness, may wear away until a stratum of the first plurality is exposed to the workpiece. In general, it may be expected for cracks to be initiated in an exposed stratum first grade of PCD when a stratum of the first plurality engages the workpiece in use.

Some example super-hard bodies may have the aspect of reducing the risk of fracture, or of delaying fracture, by guiding cracks through the super-hard body away from surfaces of the super-hard body. While wishing not to be bound by a particular theory, this may occur as a result of cracks propagating at different speeds through the strata of the first and second pluralities.

When a crack propagating through a PCD volume enters or exits a tensile region within the PCD volume, its direction may change substantially, for example by about 30° to 45°. Therefore, the path followed by cracks may be influenced by arranging tensile regions within the PCD volume; in particular, arranging tensile regions such that cracks originating near a cutting edge in use are deflected so as to reduce the risk of spalling or other catastrophic failure events.

Certain terms and concepts as used herein are briefly explained below.

As used herein, polycrystalline diamond (PCD) is a kind of super-hard material comprising an aggregation of diamond grains, a substantial portion of which are directly inter-bonded with each other, and in which the content of diamond is at least about 80% by volume of the material. In some examples, interstices between the diamond gains may be at least partly filled with a binder material comprising a catalyst for diamond; and/or at least some of the interstices may include voids. In some example arrangements, the interstices within a region of the PCD material may include voids formed by removing catalyst material. As used herein, a catalyst material for diamond is a material capable of promoting the direct intergrowth of diamond grains; examples of catalyst material may include cobalt, iron, nickel, manganese, and certain alloys comprising two or more of these metals.

As used herein, different grades of PCD material may have different microstructures, such as different grain size distributions, and/or different compositions of binder material connecting the aggregated grains. Consequently, different grades may exhibit different mechanical, electrical, chemical and other properties (when the property measurements are applied to the grade in bulk form, as opposed to relatively thin layers of the material); for example, different PCD grades may have different elastic (or Young's) modulus E, modulus of elasticity, transverse rupture strength (TRS), toughness (such as so-called $K_{1C}$ toughness), hardness, density and coefficient of thermal expansion (CTE). Different PCD grades may also behave differently in use in a tool; for example, the wear rate and fracture resistance of different PCD grades may be different.

The transverse rupture strength (TRS) of a grade of PCD material can be measured by preparing a number of rectangular bars of the PCD material and subjecting them to the three-point bending test methodology. Tests are conducted at room temperature and atmospheric pressure conditions, and load at which each specimen fails is measured. Depending on the desired precision of the measurement, about 10 to 49 specimens may be subjected to the test. For example, the relative standard deviation range may be 5% to 20% against a wide range of diamond mix strata material. Transverse rupture strength is calculated according to the following equation:

$$TRS = \frac{3PL}{2WT^2}$$

where P, L, W and T are the load value at fracture point, the span distance of the specimen between the supports, the width of the sample and the thickness of the sample, respectively. PCD grades comprising relatively small diamond grains may have a mean TRS of about 1 876 MPa, with a standard deviation of about 219 MPa; and PCD grades comprising relatively coarser diamond grains may have a TRS of about 1 222 MPa, with a standard deviation of about 163 MPa. Using a predictive regression model, an estimated TRS over a wide range of PCD grades may be 1 700 MPa to 2270 MPa.

As used herein, 'residual stress state' refers to the stress state of a body or part of a body in the absence of an externally-applied loading force. The residual stress state of a PCD structure, including a layer structure may be measured by means of a strain gauge and progressively removing material layer by layer.

As used herein, 'diamond' refers to natural or synthetic (fabricated) diamond, as single- or polycrystalline grains.

As used herein, the 'centroid' of an area (or a volume) is the arithmetic mean position of all the points in the area (or the volume). The position of a centroid of an interface boundary between a PCD volume and a substrate is determined as the centroid of an area described by the perimeter of the interface boundary as projected onto a flat surface. Regardless of the configuration of the interface boundary, which may be substantially planar or non-planar, its centroid (as used herein) will be determined by projecting its perimeter onto a plane to provide a planar shape and calculating the centroid of the projected shape. For example, if the interface boundary intersects a substantially cylindrical side area of the cutting tool, then the projected shape will be a circle, the centre of which will be the centroid of the interface boundary.

As used herein unless stated otherwise, "parallel" lines or planes are substantially parallel to each other, being at an angle of at least 0° to at most 10° to each other; and unless stated otherwise, "coaxial" features are substantially coaxial with each other, having respective central axes that are at least 0° to at most 10° to each other.

As used herein, the phrase "consists essentially of" means "consists of, apart from practically unavoidable impurities"; this may also include minor quantities of other materials or the presence of other minor features, provided that they have no substantial effect on the essential function or operation of the relevant feature or component part.

The invention claimed is:

1. A cutter element for an earth-boring tool, comprising
- a polycrystalline diamond (PCD) volume joined at an interface boundary to
- a cemented carbide substrate;
- the PCD volume including a rake face opposite the interface boundary, an edge of the rake face being suitable as a cutting edge of the cutter element; and
- the PCD volume comprising a plurality of strata directly joined to each other at inter-strata boundaries, in which
  - each of a first plurality of the strata comprises PCD material having a first diamond content;
  - each of a second plurality of the strata comprises PCD material having a second diamond content;
  - the second diamond content being greater than the first diamond content; and
  - the strata of the first and second pluralities disposed in an alternating arrangement with respect to each other;
- the strata configured and arranged such that a radial line through the edge and a centroid of the interface boundary intersects, within a maximum distance of 1,000 microns from the edge, each of the inter-strata boundaries, in which
- the respective tangent plane to each inter-strata boundary at the respective intersection is disposed relative to the radial line at no less than a minimum angle of 30°.

2. The cutter element as claimed in claim 1, in which the strata are configured and arranged such that respective radial lines through all points along an arc described by the edge intersect, within the maximum distance from the edge, the inter-strata boundaries, the respective tangent planes at the respective intersections being disposed relative to each radial line at no less than a minimum angle of 30°.

3. The cutter element as claimed in claim 1, in which each stratum of the first plurality has a thickness along the radial line that is greater than that of each stratum of the second plurality.

4. The cutter element as claimed in claim 1, in which
- the maximum distance is 500 microns; or
- the maximum distance is 500 microns to 1,000 microns.

5. The cutter element as claimed in claim 1, in which
- the minimum angle is 35°; or
- the minimum angle is 45°.

6. The cutter element as claimed in claim 1, in which the strata are configured as rings.

7. The cutter element as claimed in claim 1, in which the tangent planes to the inter-strata boundaries are parallel to each other.

8. The cutter element as claimed in claim 1, in which the inter-strata boundaries are coaxial with each other.

9. The cutter element as claimed in claim 1, in which the inter-strata boundaries at least partly surround a coaxial core region of the PCD volume.

10. The cutter element as claimed claim 1, in which each inter-strata boundary includes a respective conical surface area.

11. The cutter element as claimed in claim 1, in which at least one tangent plane to an inter-strata boundary is parallel to a longitudinal axis of the cutter element.

12. The cutter element as claimed in claim 1, in which each inter-strata boundary describes a respective curved line in a longitudinal cross-section including the radial line.

13. The cutter element as claimed in claim 1, in which the strata of the first and second pluralities are configured and arranged as complementary wedge-shaped rings.

14. The cutter element as claimed in claim 1, in which at least one of the strata is discontinuous and terminates within the PCD volume.

15. The cutter element as claimed in claim 14, in which the discontinuous stratum extends arcuately about a longitudinal axis of the cutter element and has azimuthally opposite ends that terminate within the PCD volume.

16. The cutter element as claimed in claim 1, in which
- the PCD volume includes a chamfer surface coterminous with the edge of the rake face; and
- the tangent planes to the inter-strata boundaries are parallel to a tangent plane of the chamfer surface.

17. The cutter element as claimed in claim 1, in which the PCD volume has
- a proximal boundary defined by the interface boundary,
- a distal boundary, and
- a side boundary that connects the proximal and distal boundaries; the distal and side boundaries defining a working boundary;
- the strata of the first and second pluralities extending between the proximal boundary and the working boundary.

18. The cutter element as claimed in claim 17, in which the strata of the first and second pluralities are coterminous with the working boundary, and / or the interface boundary.

19. The cutter element as claimed claim 17, in which the inter-strata boundaries converge towards each other with distance from the proximal boundary.

20. The cutter as claimed in claim 17, in which the PCD volume includes
- a proximal region between proximal ends of the strata and the proximal boundary; and / or
- a distal region between distal ends of the strata and the working boundary.

21. The cutter element as claimed in claim 1, in which the PCD volume comprises:
- a first region coterminous with the rake face and the edge, and
- a second region contiguous with the first region and remote from the rake face and the edge;

the first region comprising the first and second pluralities of strata, and the second region comprising third and fourth pluralities of strata of PCD material, in which the diamond content in the strata of the third plurality differs from the diamond content in the strata of the fourth plurality;

the strata of the third and fourth pluralities disposed in an alternating arrangement with respect to each other, and directly joined to each other at inter-strata boundaries.

22. The cutter element as claimed in claim 21, in which the strata of the third and fourth pluralities are configured and arranged such that neighbouring inter-strata boundaries between them are convergent or divergent with distance from the interface boundary.

23. The cutter element as claimed in claim 1, in which the PCD volume comprises a surface region that is coterminous with the rake face and includes no more than 2 wt. % of binder material.

24. The cutter element as claimed in claim 1, in which the PCD material of the first plurality of strata comprises diamond grains having a first mean size, and the PCD material of the second plurality of strata comprises diamond grains having a second mean size;

the first mean grain size being less than the second mean grain size.

25. The cutter element as claimed in claim 1, in which the PCD material of the first plurality comprises diamond grains having a mean grain size of 0.5 microns to 15 microns, and the PCD material of the second plurality comprises diamond grains having a mean grain size of 10 microns to 90 microns.

26. The cutter element as claimed in claim 1, in which the PCD material of the second plurality is harder than the PCD material of the first plurality.

27. The cutter element as claimed in claim 1, in which each stratum of the first plurality has a first mean thickness; and each stratum of the second plurality has a second mean thickness;

the first and the second mean thickness being 8 microns to 500 microns; or 50 microns to 500 microns.

28. The cutter element as claimed in claim 1, in which the PCD material of the strata of the first plurality comprises a binder content of 10 wt. % to 25 wt. %, and the PCD material of the strata of the second plurality comprises a binder content of 5 wt. % to 15 wt. %.

29. The cutter element as claimed in claim 1, in which the PCD material of the strata of the first plurality comprises a diamond content of 85 vol. % to 95 vol. %, and the PCD material of the strata of the second plurality comprises a diamond content of 90 vol. % to 98 vol. %.

30. The cutter element as claimed in claim 1, in which the PCD volume comprises a third plurality of strata of PCD material;

the first, second and third strata disposed in an alternating arrangement with respect to each other, such that each stratum of the second plurality is joined at an inter-strata boundary on one side to a stratum of the first plurality, and at another inter-strata boundary on the opposite side to a stratum of the third plurality; and the content of diamond material in the PCD material of the third plurality is greater than that of the strata of the second and first pluralities.

31. Thr cutter element as claimed in claim 1, in which the PCD material of the strata of at least one of the first or second pluralities includes elongate grains of non-diamond material.

32. An earth boring tool comprising the cutter element as claimed in claim 1.

* * * * *